US007044824B2

(12) United States Patent
Chavez

(10) Patent No.: US 7,044,824 B2
(45) Date of Patent: May 16, 2006

(54) ROOF SYSTEM FOR A LOG BUILDING TOY

(76) Inventor: Raul Chavez, 1650 Sioux Dr. CH44-766, El Paso, TX (US) 79925

( * ) Notice: Subject to any disclaimer, the term of this patent is extended or adjusted under 35 U.S.C. 154(b) by 0 days.

(21) Appl. No.: 10/462,063

(22) Filed: Jun. 16, 2003

(65) Prior Publication Data

US 2003/0233799 A1 Dec. 25, 2003

(30) Foreign Application Priority Data

Jun. 24, 2002 (MX) ..... PA/a/2002/006946

(51) Int. Cl.
*A63H 33/08* (2006.01)

(52) U.S. Cl. ..... 446/106; 52/233

(58) Field of Classification Search ..... 52/233, 52/18, 90.1, 92.1; 446/106
See application file for complete search history.

(56) References Cited

U.S. PATENT DOCUMENTS 1,510,326 A * 9/1924 Locke ..... 52/92.1
4,312,161 A * 1/1982 Goldade ..... 52/233
4,372,076 A * 2/1983 Beck ..... 446/106
6,059,630 A * 5/2000 Paxton et al. ..... 446/106

* cited by examiner

*Primary Examiner*—Naoko Slack

(57) ABSTRACT

The invention titled "Roof System for a Log Building Toy" (hereinafter "The Roof") under this section consists of the design of the parts and the unique process of assembly of The Roof.

The design of the pieces of The Roof include logs and slats that provide a new and unique manner of assembly of a log building toy or construction play set. The name of the pieces, proper identification, their description, functions and physical characteristics are described in detail on The Specification attached as well as in the nine drawings submitted along with the application.

The process of assembly consists on the edification of The Roof by placing and positioning two Lateral Support Logs on sides on top of building's structure, a Central Support Log on the center on top of building's structure, and then placing the Special Roof Slats a the top of the building, which are held together in place by the Lateral Support Logs to get The Roof fully assembled. This process of assembly is detailed stage by stage on The Specification as well as in the attached drawings submitted along with the application.

3 Claims, 9 Drawing Sheets

ROOF SYSTEM FOR A LOG BUILDING TOY

THE PRECISE DIMENSIONS OF
THE PART ARE NOT CLAIMED

THE PRECISE DIMENSIONS OF
THE PART ARE NOT CLAIMED

THE PRECISE DIMENSIONS OF THE PART ARE NOT CLAIMED

ROOF SYSTEM FOR A LOG BUILDING TOY

A portion of the disclosure of this patent document contains material, which is subject to copyright or mask work protection. The copyright or mask work owner has no objection to the reproduction by anyone of the patent document or the patent disclosure, as it appears in the United States Patent and Trademark Office patent file or records, but otherwise reserves all copyrights or mask work rights whatsoever.

BACKGROUND OF THE INVENTION

This document contains the information regarding the background and the description of the invention for which this patent application is being submitted.

The present patent application is kindly submitted with the purpose to protect the use and design of a roof system for a wooden log building toy.

1. Field of the Invention

Wooden log building toys or construction play sets.

2. Description of the Related Art

Currently, log building toys or play sets made with traditional wood logs and other components made of wood or plastic which are used to build cabins, forts and other structures, use a roof system that requires conventional Roof Holder Logs, conventional solid Gables and conventional Roof Slats to fully assemble the roofing area. These components are expensive to manufacture and subsequently the price of the product is adversely affected.

3. The Invention by itself

With the firm purpose to develop a new and enhanced product that can afford to compete against Asian-made, mainly Chinese-made toys, which rule over the toy industry worldwide, hereby is presented an educational toy model that uses a new and different system to assemble the roof and that differs greatly from the traditional and existing roof systems. For this reason, the new roof system was developed and the present patent application is kindly submitted, as this is a system that drastically reduces the manufacturing cost by using new and novel components that are easier and less expensive to manufacture than the conventional Roof Holder Logs, conventional solid Gables and conventional Roof Slats that are currently being used by most manufacturers. In addition, this new roof system provides a different look and appearance to the cabins, forts and other structures built with it. This roof system for a log building toy was designed for boys and girls 3 years and up. The toy parts and components by itself can be arranged to assemble completely a firm and rigid structure. No tools, nails, glue or screws are required to complete the assembly. All parts have been finished with safe non-toxic materials. Adult guidance is recommended but it is not necessary.

The purpose of this construction toy set, is to enhance the child's skill and imagination. It is intended to provide hours of fun and learning, to young children. The play set has unique parts and features that enable the child to build a cabin or a larger building within minutes.

BRIEF SUMMARY OF THE INVENTION

The present patent application refers to an educational toy that enables kids from ages 3 and up, to build small or large toy constructions, starting with a small cabin up to a large western fort and many other modern buildings, employing a roofing system, which is new and non-obvious. This roofing system besides providing a different look and appearance to the traditional log construction toys, it enables to reduce in a substantial manner the manufacturing cost.

The main object of this invention is to provide an educational building toy with an alternative way to assemble the roof system, which is totally different to the actual roofing systems used on log building toy sets available on the current market place. This is achieved through a building principle which rigidity and structural firmness rely on a system comprised of logs and slats that interlock with each other, and that does not requires conventional Roof Holder Logs, neither costly conventional solid Gables, neither conventional Roof Slats, resulting on a different facade an building appearance and also, substantially reducing the manufacturing cost.

BRIEF DESCRIPTION OF THE SEVERAL VIEWS OF THE DRAWINGS

Several embodiments of the invention are described hereinafter with reference to the attached drawings, following the same reference characters used to show the different parts and figures displayed. The invention is not meant to be limited to these specific structural arrangements.

DETAILED DESCRIPTION OF THE INVENTION

Figure 1:
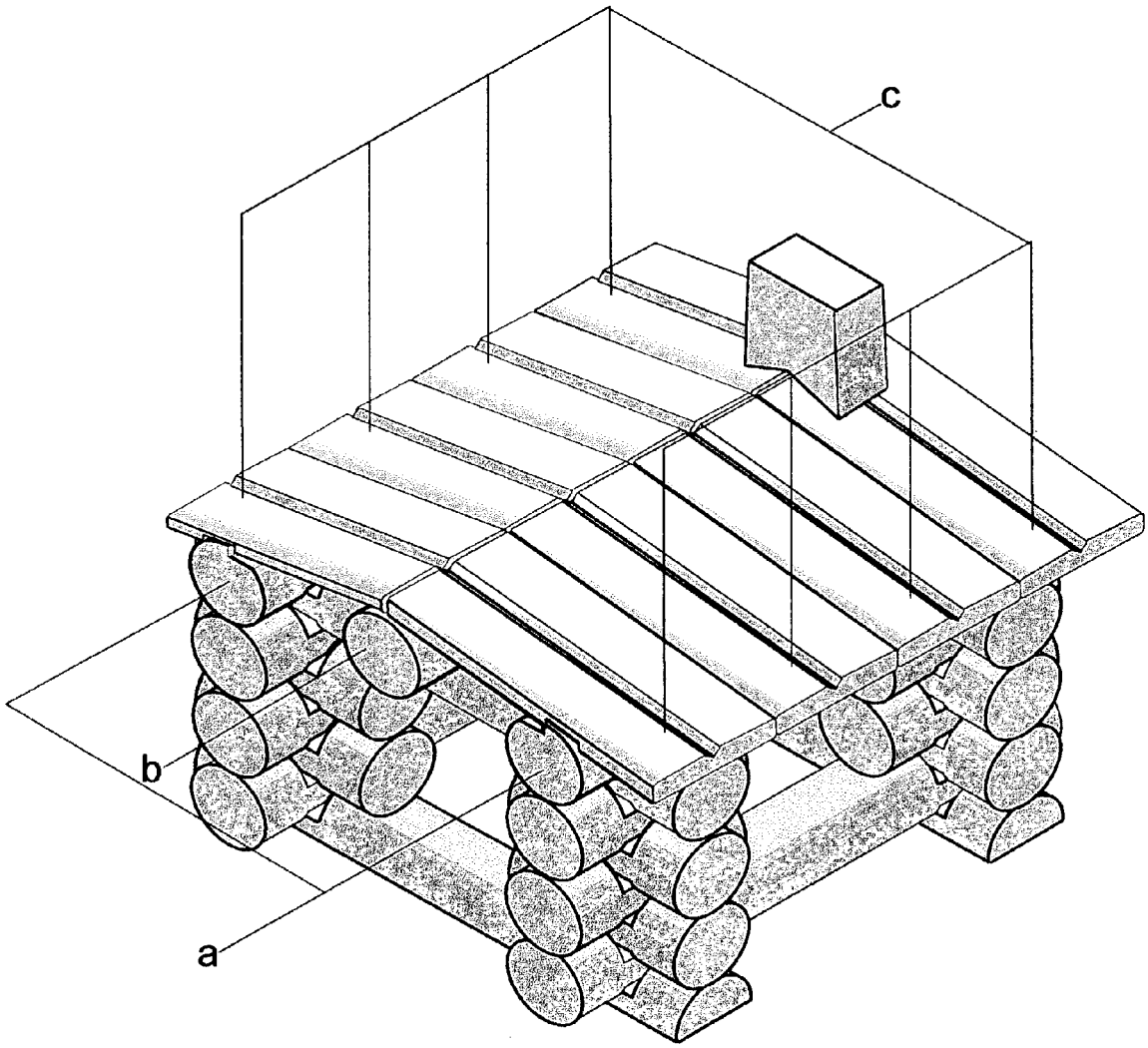
FIG. 1 is a perspective view of the top of the building illustrating the fully assembled model, showing the main components of the new roof system.

The main details regarding this toy construction model and the new and novel system to assemble the roof, are clearly explained on the description and the subsequent 9 (nine) drawings attached, following the same reference characters used to show the different parts and figures displayed.

For purposes of clarity and simplicity, the construction of a small cabin has been chosen, that although simple, it has all main components and parts involved as well as the basic construction principles subject of this patent application.

On FIG. 1 an overall view of the fully assembled model is shown, detailing the main components of this new roof system.

Figure 2:
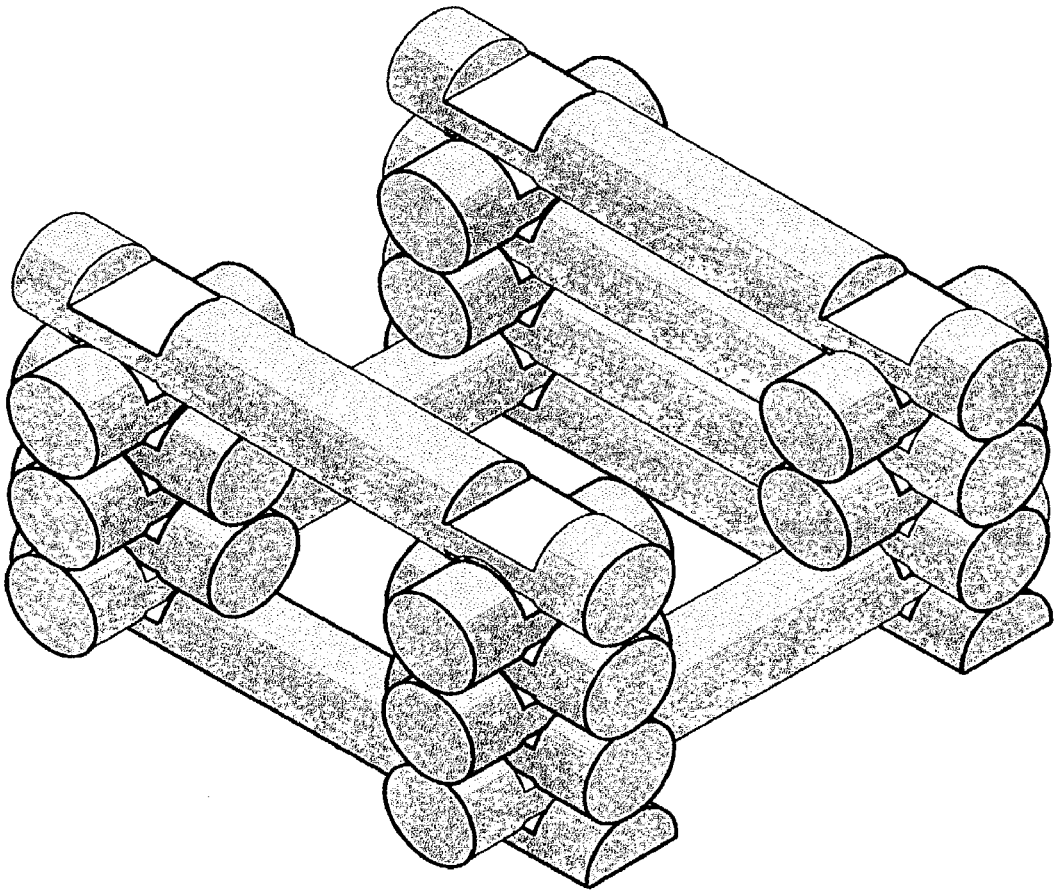
FIG. 2 is a perspective view of the top of the building illustrating the basic toy log cabin structure before the roof system is assembled. Logs and structure shown on this particular view ARE NOT the subject of the present patent application.

On FIG. 2 the basic toy log cabin structure is shown before any component of the new roof system is put in place or becomes assembled.

Figure 3:
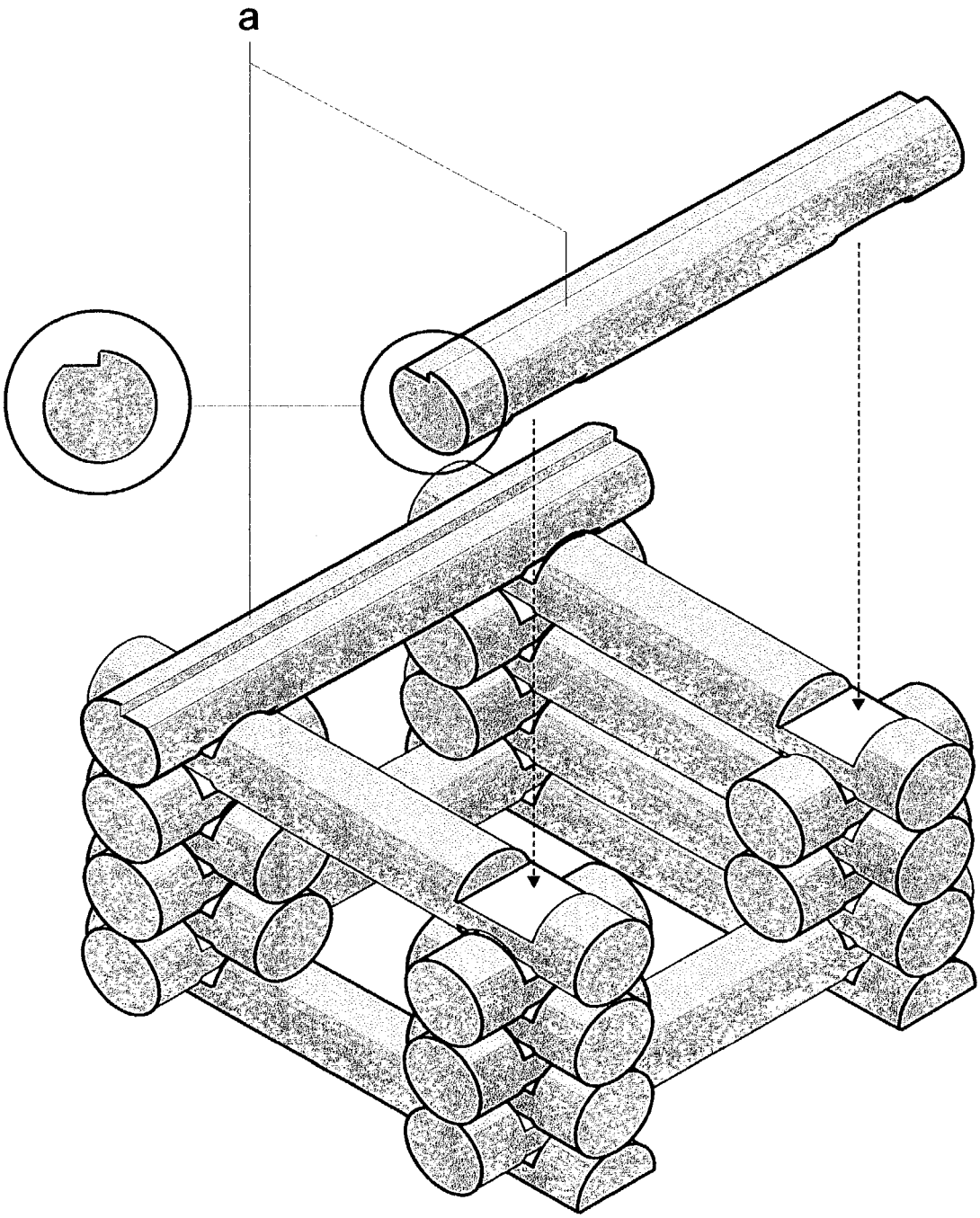
FIG. 3 is a perspective view of the top of the building showing the way to put in place the Lateral Support Logs (a). On drawing it is also shown a cross-sectional view of the Lateral Support Log. This part is a new and novel component subject of this patent application.

The first step to assemble the roof system begins on FIG. 3 where the way to place the Lateral Support Logs (a) is shown. These logs have bottom notches that are used to hold together the log with the main structure. On FIG. 3 both Lateral Support Logs were drawn with two bottom notches as a simple cabin is being built, but in order to build a larger structure, Lateral Support Logs with three or more bottom notches should be used. Lateral Support Logs with three bottom notches are not shown on FIG. 3, but are shown in detail on FIG. 7. It is important to note, as shown on drawing detail, that Lateral Support Logs (a) have an upper slot executed on the full length of the log that will be used on the final step to hold the Special Roof Slats (c). For this reason and in order to provide an effective way to hold firmly in place the Special Roof Slats, Lateral Support Logs (a) must be placed with the upper slot facing to the inside of the building; that is, the upper slots executed on the length of the Lateral Support Logs must be placed facing each other as shown on drawing. Special Roof Slats (c) are not shown on FIG. 3, but are shown on FIGS. 5 and 9.

Figure 4:
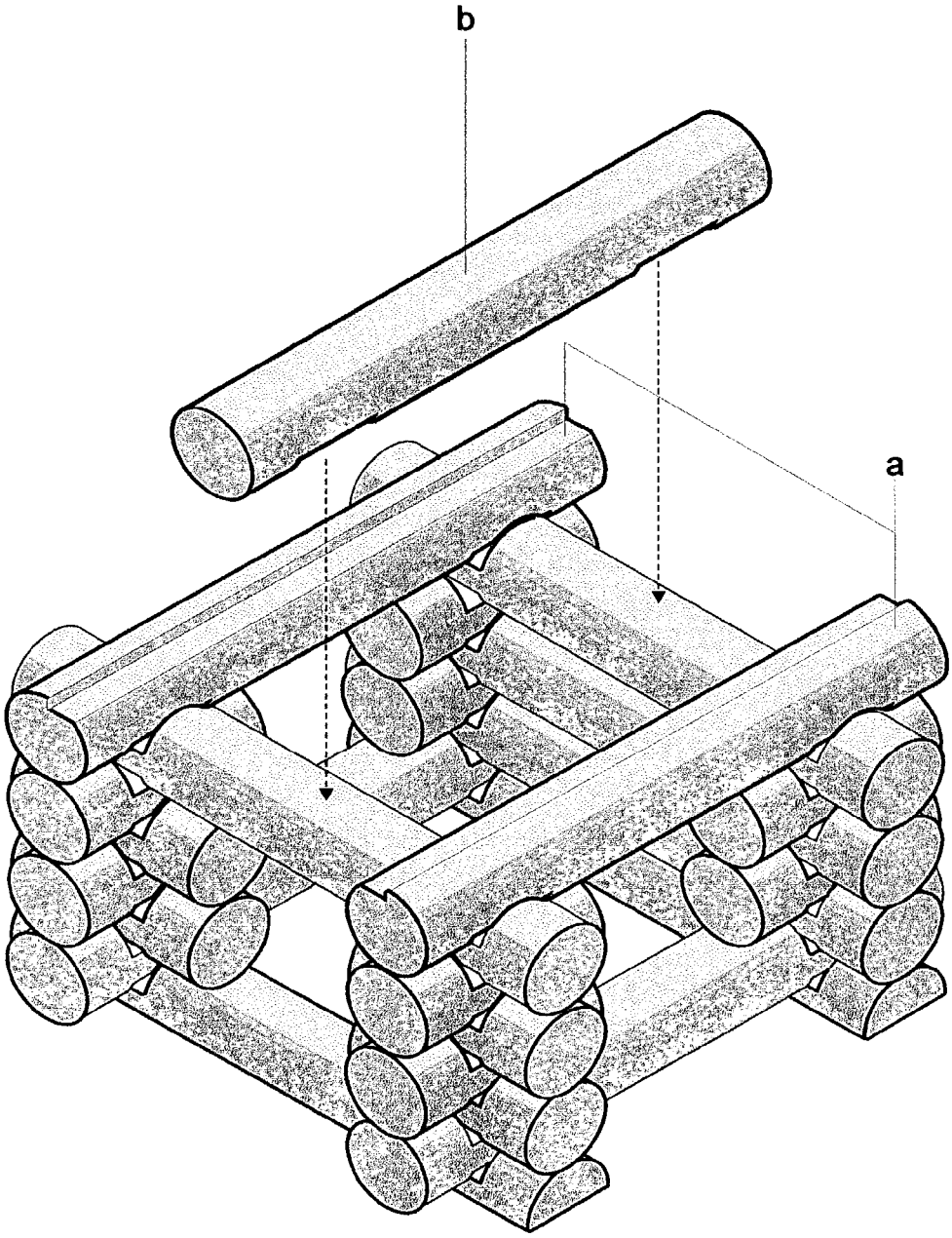
FIG. 4 is a perspective view similar to FIG. 3, but showing the way to put in place the Central Support Log (b). This part is a new and novel component and is also subject of this patent application.

Once Lateral Support Logs (a) are placed correctly, the Central Support Log (b), must be put in place as seen on FIG. 4. The Central Support Log should be positioned about the center distance in-between Lateral Support Logs (a). No precision or accuracy is needed in placing this part, because the Special Roof Slats (c) have enough slack to play with and the child can make the proper adjustments as needed. By using Lateral Support Logs (a) and a Central Support Log (b), it becomes possible to completely eliminate the use of expensive and conventional components as the Roof Holder Logs and solid wood Gables that are used on most log building play sets. The Central Support Log (b) was drawn with two bottom notches because a simple cabin is being built, but in order to build a larger structure, a Central Support Log with three or more bottom notches should be employed. A Central Support Log with three bottom notches is not shown on FIG. 4, but it is shown in detail on FIG. 8. Also, the Special Roof Slats (c) are not shown on FIG. 4, but are shown on FIGS. 5 and 9.

Figure 5:
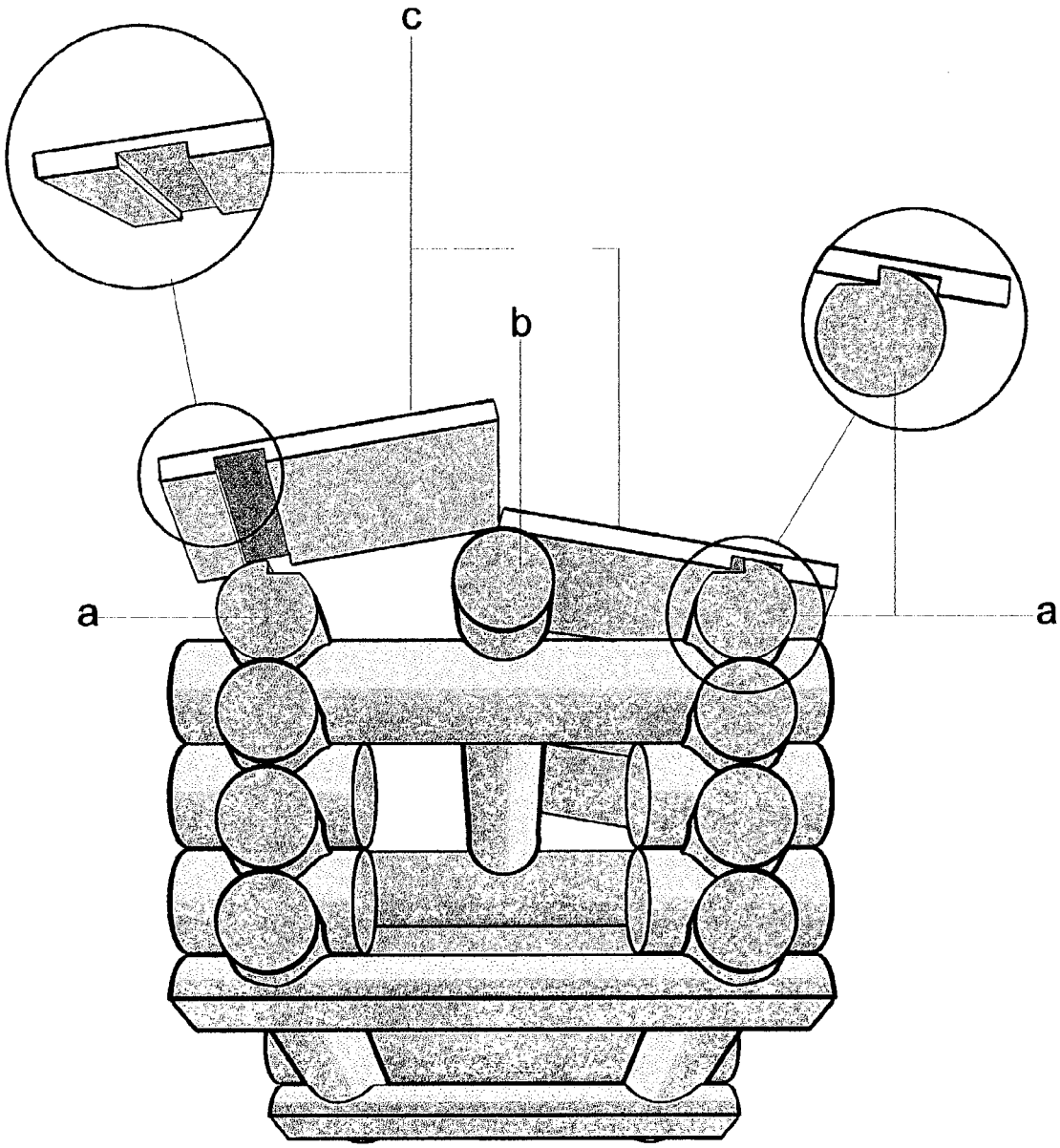
FIG. 5 is a perspective view as seen from the bottom of the building, illustrating the way to put in place the Special Roof Slats (c). On drawing appears a view showing details of the Slats. This part also, is a new and novel component subject of this patent application.

The final step is the placing of the Special Roof Slats(c) as illustrated on FIG. 5. These slats have a notch or slot on the bottom and executed on the width of the piece as shown on drawing detail. The purpose of this bottom slot is to hold in place each Special Roof Slat locked with the upper slot executed on the full length of the Lateral Support Logs (a), and by this way each piece is held together in place in a sturdy and rigid structure providing roofing to the cabin or the building. It becomes important to mention that these Special Roof Slats (c) are much shorter than the conventional roof slats used on most log building play sets. This reduces the manufacturing cost of these pieces. On FIG. 5, the assembly of all building components is shown as seen from the bottom of the system, which enables to realize the way the logs are hold together with the roof slats by making use of the notches or slots, and special cuts executed on all different pieces that conform the system.

Figure 6:
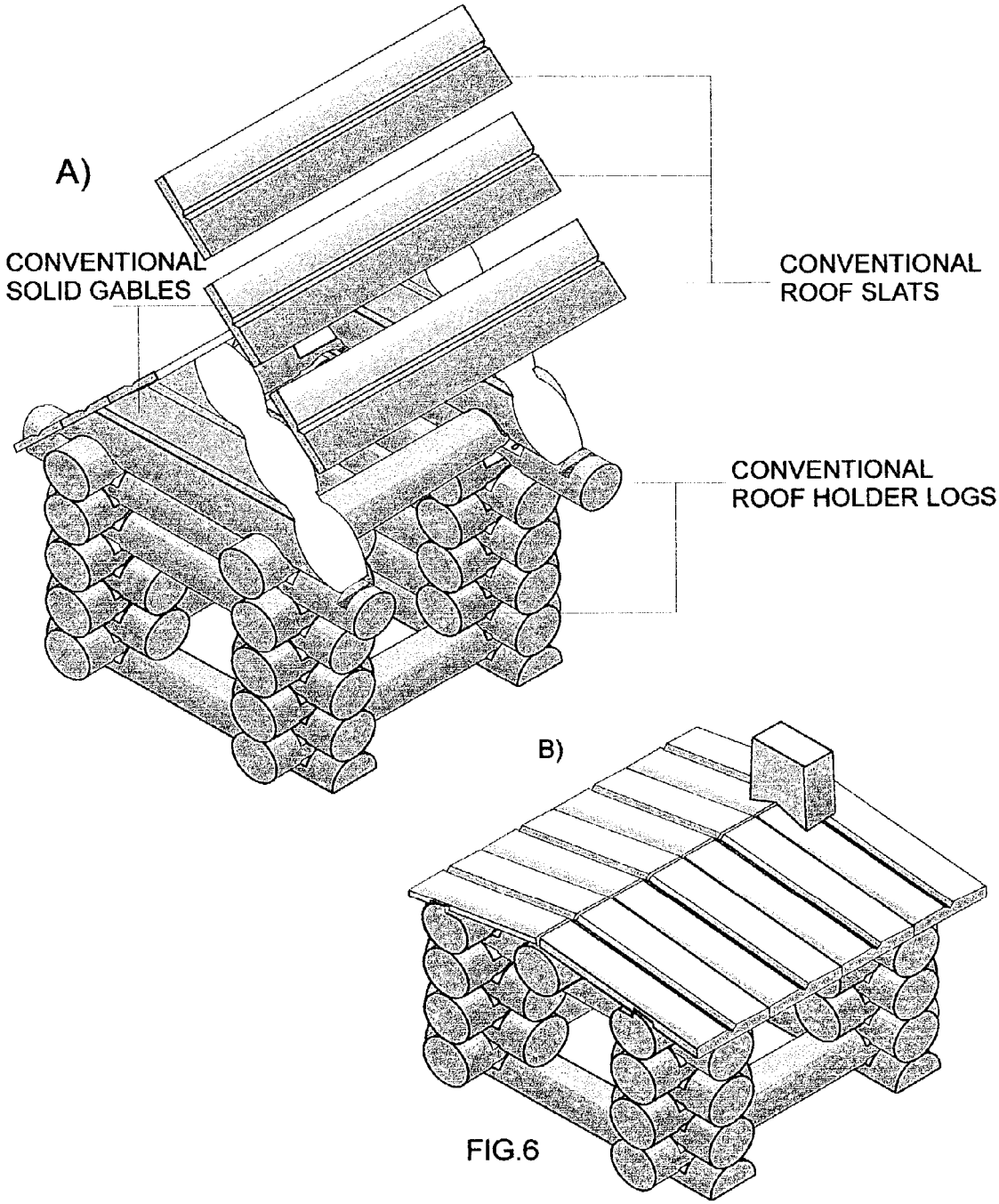
FIG. 6 is a perspective view from the top illustrating a comparison between both systems: A.) The traditional log building system that employs conventional Roof Holder Logs, conventional solid Gables and conventional Roof Slats, and B.) The new system previously described and subject of this patent application.

FIG. 6 shows a comparison between both systems: A.) The traditional log building system that employs conventional Roof Holder Logs, conventional solid Gables and conventional Roof Slats, and B.) The new system previously described and which is the subject matter of the present patent application. To finalize with FIG. 6, and for purposes of simplicity and enough clarity, a small and simple log cabin has been used to show and compare both roof systems.

Figure 7:
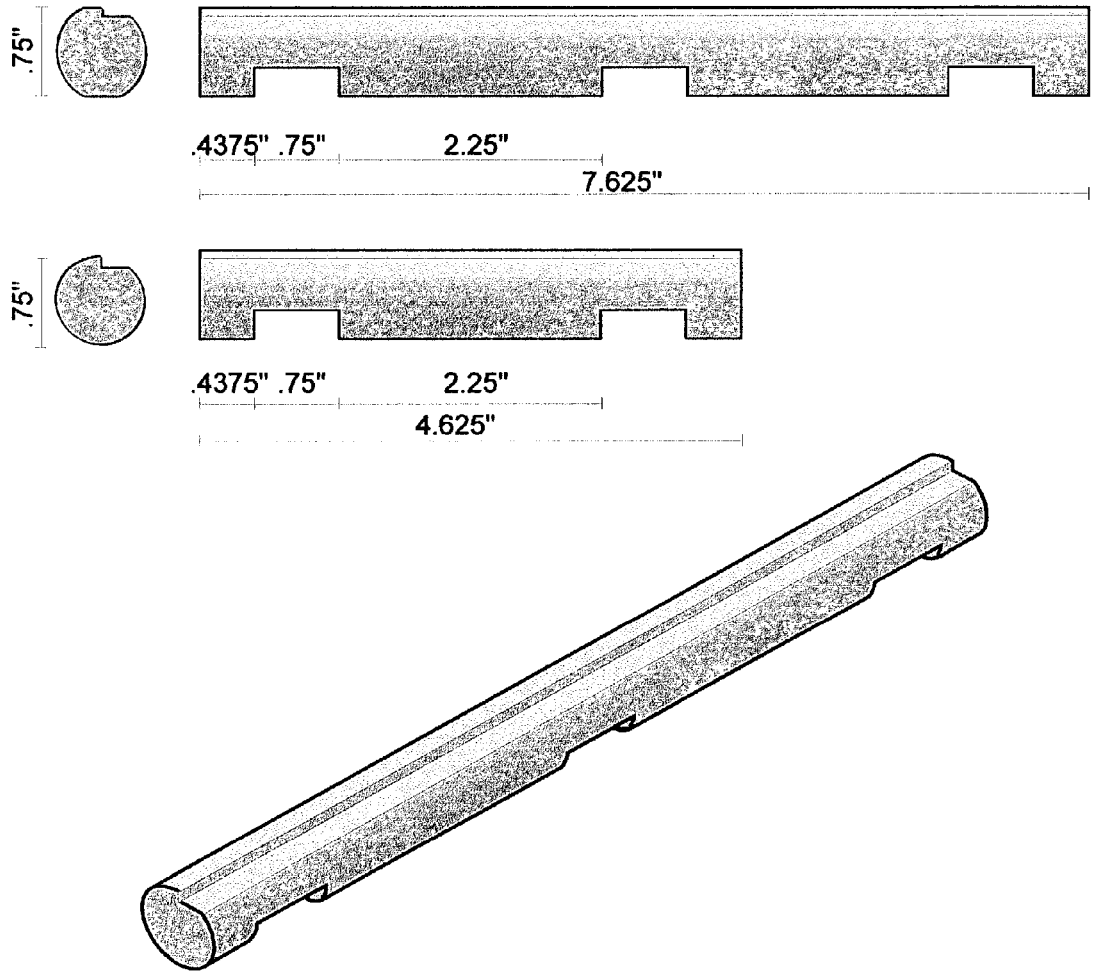
FIG. 7 shows dimensions of the Lateral Support Log (a on FIG. 3). On FIG. 7, two options are illustrated, a large one with three bottom notches and a short one with two bottom notches. Both parts are the subject matter of the present patent application. The precise dimensions of the parts are not claimed. Dimensions are shown to have a better understanding of the part.

FIG. 7 shows dimensions of the Lateral Support Log (a on FIG. 3). On this drawing, two Lateral Support Logs are illustrated; a large one with three bottom notches and a molded shape pattern with round sides and flats top and bottom, and a short one round with two bottom notches. Both parts are the subject matter of the present patent application. The precise dimensions of the parts are not claimed. Dimensions are shown for a better understanding of the parts.

Figure 8:
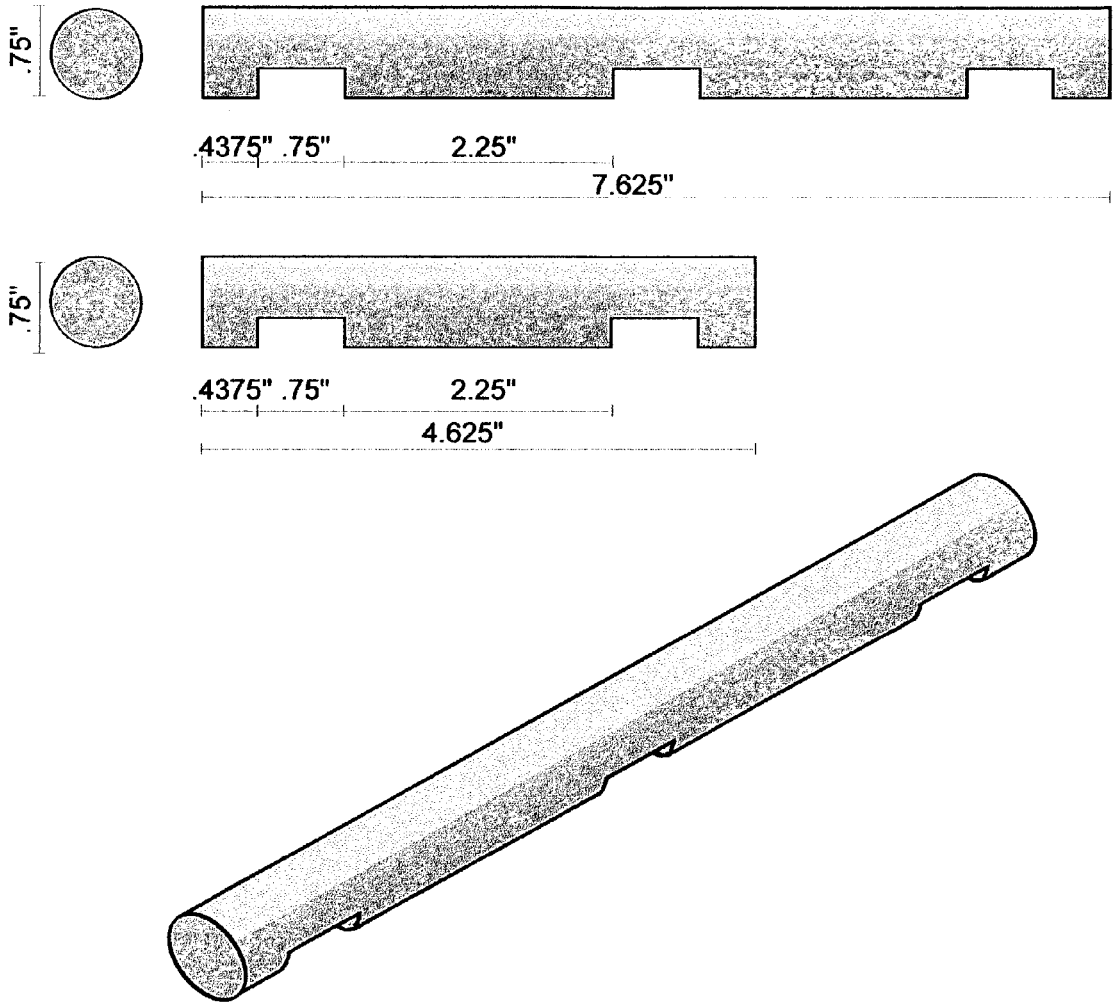
FIG. 8 shows dimensions of the Central Support Log (b on FIG. 4). Again, on FIG. 8, two options are illustrated, a large one with three bottom notches and a short one with two bottom notches. Both parts are also the subject matter of the present patent application. The precise dimensions of the parts are not claimed. Dimensions are shown to have a better understanding of the part.

FIG. 8 shows dimensions of the Central Support Log (b on FIG. 4). On this drawing, two Central Support Logs are shown, a large one round with 3 bottom notches and a short one round with 2 bottom notches. Both parts are also the subject matter of the present patent application. The precise dimensions of the parts are not claimed. Dimensions are shown for a better understanding of the parts.

Figure 9:
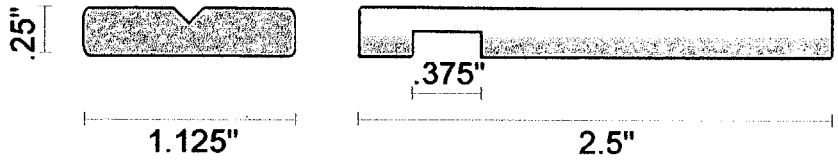
FIG. 9 shows dimensions of the Special Roof Slat (c on FIG. 5). This part is also the subject matter of the present patent application. The precise dimensions of the part are not claimed. Dimensions are shown to have a better understanding of the part.
Figure 9:
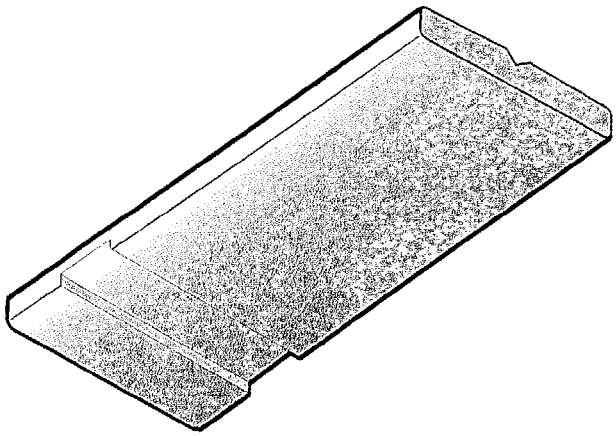

FIG. 9 shows dimensions of the Special Roof Slats (c on FIG. 5). This part is also the subject matter of the present patent application. The precise dimensions of the part are not claimed. Dimensions are shown for a better understanding of the part.

The toy model presented on this patent application and the new roofing system once it is fully assembled, it becomes a rigid and sturdy structure capable of standing by itself, and it's components provide great versatility in regards to the different sizes and functions that the construction may have.

The novelty and main feature of this system to assemble the cabin's roof is the way to put and hold in place the Special Roof Slats (c), and the form these slats hold together and lock in place with the upper slot on the Lateral Support Logs (a), keeping all pieces firmly in place.

Based on the above description, this educational building toy provides the following characteristics:

- It is an educational toy that develops eye and hand coordination while it stimulates the child's creativity and imagination at an early stage.
- Neither glue nor nails required during assembly.
- Easy to assemble and disassemble as many times as desired.
- It is a safe toy. Paint used on finishing is non-toxic and parts have no sharp edges.
- Endless and limitless building possibilities. Starting with a small log cabin up to a Fort as those built on the old west. Nevertheless, the toy design can be employed on modern and contemporary constructions and buildings as fire and rescue stations, police squads, military quarters, schools, gas stations, garages and other dynamic building play sets.

100% compatible with other log building play sets.

The invention claimed is:

1. The process of assembly and the design of the pieces for the system to build and firmly support the roof of a toy log cabin, the process steps comprising:

a. Providing two Lateral Support Logs with bottom notches and an upper slot executed on the full length of each log.

b. Providing a Central Support Log with bottom notches that is used instead of a gable and, c. Placing several Special Roof Slats with a bottom slot that gets locked with the upper slot on the Lateral Support Logs, providing firmness and rigidity to the roof structure.

2. The process of claim 1, further comprising the steps of forming specific cuts, grooves and notches on different components, which provides firmness and rigidity to the roof.

3. The process of claim 1, further providing a Central Support Log that replaces the conventional gable, which is used on most other log building toys.

* * * * *